US006086342A

United States Patent [19]

Utter

[11] Patent Number: 6,086,342

[45] Date of Patent: Jul. 11, 2000

[54] INTERMEDIATE PRESSURE REGULATING VALVE FOR A SCROLL MACHINE

[75] Inventor: Robert E. Utter, Adrian, Mich.

[73] Assignee: Tecumseh Products Company, Tecumseh, Mich.

[21] Appl. No.: 09/042,092

[22] Filed: Mar. 13, 1998

Related U.S. Application Data

[60] Provisional application No. 60/056,233, Aug. 21, 1997.

[51] Int. Cl.[7] ..... F04C 18/04

[52] U.S. Cl. ..... 418/55.5; 418/57

[58] Field of Search ..... 418/55.5, 57

[56] References Cited

U.S. PATENT DOCUMENTS

| | | | |
|---|---|---|---|
| 4,350,479 | 9/1982 | Tojo et al. | 418/55.5 |
| 4,365,941 | 12/1982 | Tojo et al. | 417/372 |
| 4,475,874 | 10/1984 | Sato | 418/55.5 |
| 4,496,296 | 1/1985 | Arai et al. | 418/55.5 |
| 4,519,413 | 5/1985 | Wagenseil et al. | 137/111 |
| 4,596,520 | 6/1986 | Arata et al. | 418/55.5 |
| 4,669,962 | 6/1987 | Mizuno et al. | 418/55.5 |
| 4,743,181 | 5/1988 | Murayama et al. | 418/55.5 |
| 4,928,503 | 5/1990 | Riffe | 62/498 |
| 4,968,232 | 11/1990 | Kikuchi | 418/55.5 |
| 5,131,828 | 7/1992 | Richardson, Jr. et al. | 418/55.3 |
| 5,217,359 | 6/1993 | Kawahara et al. | 418/55.4 |
| 5,252,046 | 10/1993 | Wen-Ding et al. | 418/55.5 |
| 5,263,822 | 11/1993 | Fujio | 418/55.4 |
| 5,383,772 | 1/1995 | Richardson, Jr. et al. | 418/55.4 |
| 5,520,526 | 5/1996 | Fujio | 418/55.4 |
| 5,562,435 | 10/1996 | Cho et al. | 418/55.5 |
| 5,591,014 | 1/1997 | Wallis et al. | 417/310 |
| 5,607,288 | 3/1997 | Wallis et al. | 417/310 |

FOREIGN PATENT DOCUMENTS

| | | | |
|---|---|---|---|
| 57-76291 | 5/1982 | Japan . | |
| 58-160580 | 9/1983 | Japan . | |
| 58-160583 | 9/1983 | Japan . | |
| 58-183887 | 10/1983 | Japan . | |
| 60-228787 | 11/1985 | Japan | 418/55.5 |
| 3-64686 | 3/1991 | Japan | 418/55.5 |
| 4-334784 | 11/1992 | Japan | 418/55.5 |
| 5-1677 | 1/1993 | Japan . | |

*Primary Examiner*—John J. Vrablik
*Attorney, Agent, or Firm*—Baker & Daniels

[57] ABSTRACT

A valve for regulating pressure intermediate suction and discharge pressure in a scroll compressor having an axially sealing interface between a fixed and orbiting scroll member through which the axial relationship between the scroll members may be controlled. The scroll members are axially biased together by refrigerant gas at a pressure intermediate the suction and discharge pressures and which is disposed in an intermediate pressure chamber defined in part by a generally planar surface of the orbiting scroll member. A self-regulating sliding valve, actuated by forces exerted on axial valve surfaces by suction, discharge and intermediate gas pressures, controls the amount of intermediate gas pressure in the intermediate gas pressure chamber. An annular groove in fluid communication with a longitudinal bore within the valve body and which opens to the intermediate pressure chamber is moved between a first position, in which the annular valve groove communicates with a passage to the compressor discharge pressure chamber, and a second position, in which the annular valve groove communicates with a passage to the compressor suction pressure chamber, placing the intermediate pressure chamber in communication with the discharge and suction pressure chambers, respectively. A third position, intermediate the first and second positions, seals the intermediate pressure chamber. Hence the axial engagement force exerted between the fixed and orbiting scroll members is controlled and a constant wrap to face clearance between the fixed and orbiting scroll members is maintained.

10 Claims, 4 Drawing Sheets

INTERMEDIATE PRESSURE REGULATING VALVE FOR A SCROLL MACHINE

CROSS-REFERENCE TO RELATED APPLICATION

This application is related to and claims the benefit under 35 U.S.C. § 119(e) of U.S. provisional patent application Ser. No. 60/056,233, filed Aug. 21, 1997.

BACKGROUND OF THE INVENTION

1. Field of the Invention

The present invention relates generally to scroll compressors which include fixed and orbiting scroll members and, more particularly, to a valve which regulates a pressure intermediate suction and discharge pressures to maintain sealing axial engagement between the orbiting scroll member and the fixed scroll member.

2. Description of the Related Art

A typical scroll compressor comprises two facing scroll members, each having an involute wrap wherein the respective wraps interfit to define a plurality of closed compression pockets. When one of the scroll members is orbited relative to the other member, the pockets decrease in volume as they travel between a radially outer suction port and a radially inner discharge port. The pockets thereby convey and compress a fluid, typically a refrigerant, contained therein.

During compressor operation, the pressure of the compressed refrigerant tends to force the scroll members axially apart. Axial separation of the scroll members causes the closed pockets to leak at the interface between the wrap tips of one scroll member and the face of the other scroll member. Such leakage reduces the operating efficiency of the compressor and, in extreme cases, may result in the inability of the compressor to operate.

Efforts to counteract the separating force applied to the scroll members during compressor operation, and thereby minimize the aforementioned leakage, have resulted in the development of a variety of axial compliance mechanisms. For example, it is known to axially preload the scroll members toward each other with a force sufficient to resist the dynamic separating force. One approach is to assure close manufacturing tolerances for the component parts and have a thrust bearing interface between the fixed and orbiting scroll members for conveying axial forces between the members. The most common approach is to feed back compressed refrigerant gas to urge the two scroll members together.

Typically, the axial compliance forces bias the tips of the scroll compressor wraps against the inner surface of the opposite scroll and/or may bias sliding surfaces on the outer perimeter of the two scroll members into mutual engagement. Frictional forces are created at these areas of contact as the moveable scroll is orbited about the fixed scroll. Excessive frictional forces generated by the axial compliance mechanism can increase the power required to operate the scroll compressor and have an abrasive effect on the engagement surfaces. The abrasive effects created by the axial compliance forces can damage or lead to excessive wearing of the wrap tips and interior surfaces, or faces, of the two scrolls when the axial compliance forces are borne by these surfaces and thereby negatively impact the sealing ability and longevity of the wrap tips.

Some prior art scroll compressors provide passageways in the orbiting scroll member plate through which a portion of the compression chamber formed by the interfitting scroll wraps, in which refrigerant is at intermediate pressure, is in direct fluid communication with an intermediate pressure chamber formed in part by the side of orbiting scroll member opposite that on which scroll wraps are disposed. The refrigerant gas in the intermediate pressure chamber exerts an axial sealing force between the orbiting and fixed scroll members. However, under certain operating conditions, such as on compressor startup, such arrangements can create intermediate pressures greater than discharge pressure, forcing the fixed and orbiting scroll members together too tightly, resulting in compressor inefficiency. Conversely, where suction pressures are very low intermediate pressures may also be low, and such arrangements can provide inadequate axial sealing force between the fixed and orbiting scroll members. A method of regulating the intermediate pressure to bias the fixed and orbiting scroll members into consistent and proper sealing engagement under varying compressor operating conditions is needed.

SUMMARY OF THE INVENTION

The present invention provides an intermediate pressure regulation valve for regulating the intermediate pressure to bias the orbiting scroll member into consistent, proper sealing engagement with the fixed scroll member under varying operating conditions. The regulation of intermediate pressure by the inventive valve reduces frictional power losses and maintains the tips and interior surfaces of the fixed and orbiting scrolls at fixed relative axial positions.

The present invention provides a scroll compressor having a suction pressure chamber and a discharge pressure chamber comprising a fixed scroll member having a fixed involute wrap element projecting from a first substantially planar surface, and an orbiting scroll member having an orbiting involute wrap element projecting from a second substantially planar surface and a third substantially planar surface opposite the second substantially planar surface and substantially parallel thereto. The fixed and orbiting scroll members are adapted for mutual engagement with the fixed involute wrap element projecting towards the second surface and the orbiting involute wrap element projecting towards the first surface. The first surface is positioned substantially parallel with the second surface whereby relative orbiting of the scroll members compresses fluids between the involute wrap elements. An intermediate pressure chamber in part bounded by the third substantially planar surface of the orbiting scroll member is in fluid communication via a spring-biased valve with the discharge pressure chamber in one valve position and with the suction pressure chamber in another valve position, the valve activated by a fluid pressure differential between the intermediate pressure chamber and the discharge pressure chamber. Alternatively, the fluid at regulated intermediate pressure could be applied to a fixed scroll supported for limited axial movement. Through such arrangement the fixed and orbiting scroll members are maintained in proper axial sealing engagement by forces induced by fluid pressure in the intermediate pressure chamber.

An advantage of the present invention is that by utilizing the intermediate pressure regulation valve to control the intermediate pressure the wrap tips do not bear excessive axial compliance forces and can be held at a fixed position relative to the opposite scroll surface. The wrap tips are thereby subjected to less wear.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
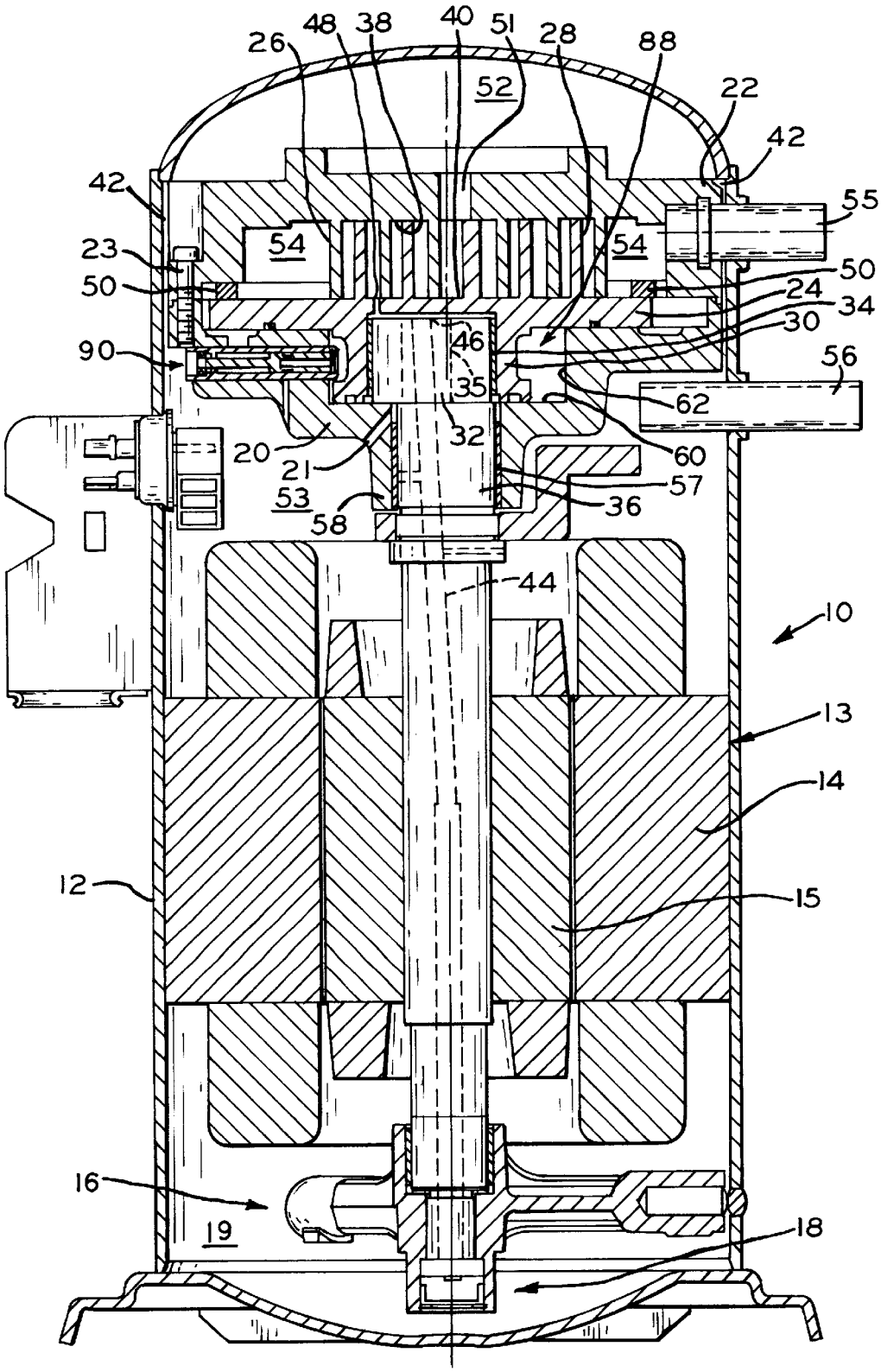
FIG. 1 is a longitudinal sectional view of a scroll compressor including an embodiment of the present invention.

Corresponding reference characters indicate corresponding parts throughout the several views. The drawings, which represent embodiments of the present invention, are not necessarily to scale and certain features may be exaggerated. Although the exemplification set out herein illustrates embodiments of the invention in several forms, the embodiments disclosed below are not intended to be exhaustive or limit the invention to the precise forms disclosed in the following detailed description and are not to be construed as limiting the scope of the invention in any manner.

DESCRIPTION OF THE PRESENT INVENTION

Figure 2:
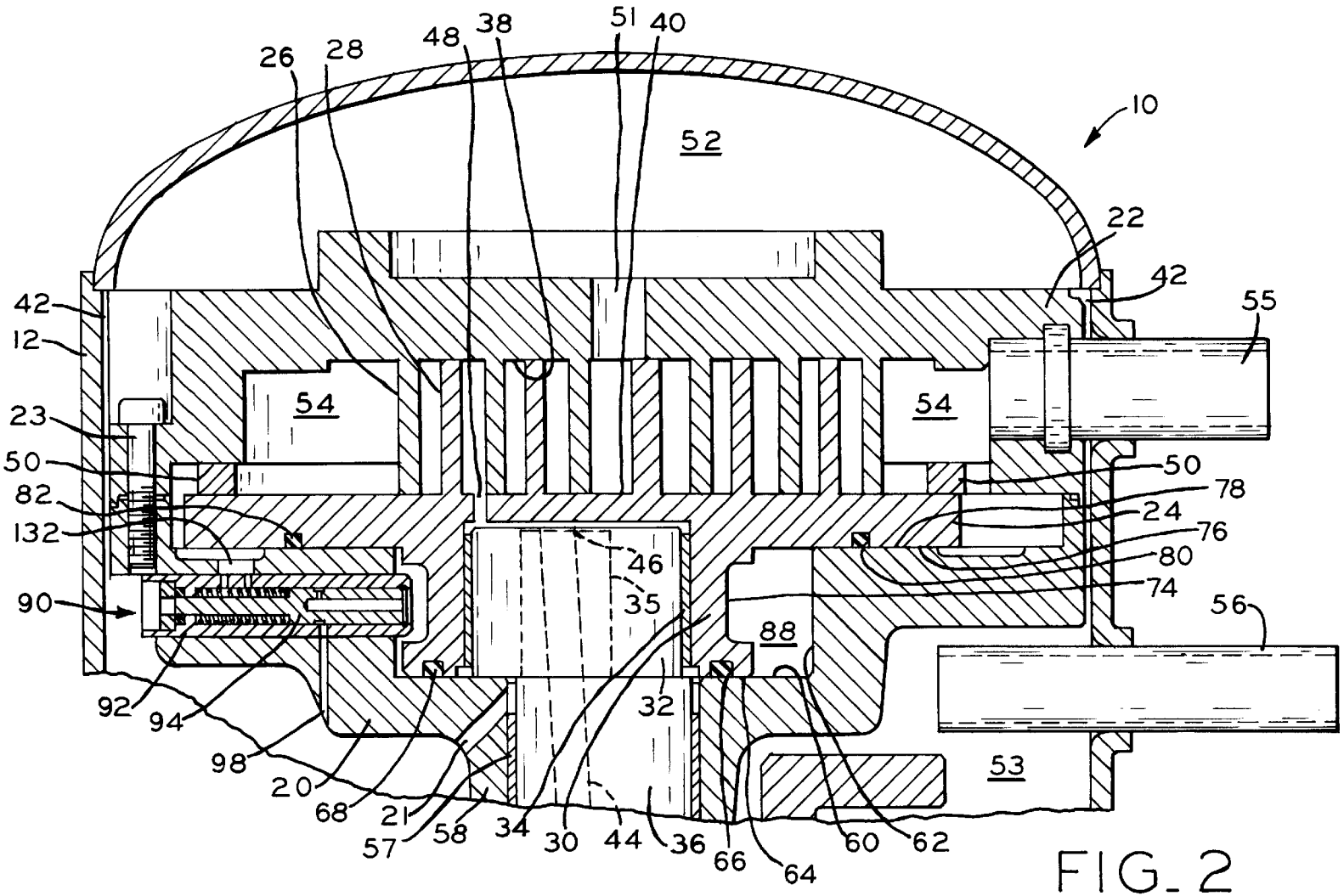
FIG. 2 is an enlarged, fragmentary sectional view of the upper portion of the scroll compressor shown in FIG. 1.

Referring now to the drawings and particularly to FIGS. 1 and 2, there is shown a scroll compressor 10 comprising housing 12, motor 13 having stator 14 and rotor 15, crankshaft 36 upon which rotor 15 of motor 13 is attached, outboard bearing assembly 16 located in the lower portion of housing 12 and in which shaft 36 is journaled and axially supported, and oil pump 18 by which oil is moved from sump 19 located in the lower portion of housing 12 to lubricated parts of the compressor. Scroll compressor 10 further includes fixed scroll member 22 and orbiting scroll member 24. The fixed and orbiting scroll members 22, 24 each have a volute shaped scroll element, or wrap, 26 and 28 respectively. The scroll wraps 26, 28 interfit and are used to compress gases in a well known manner by orbiting the orbiting scroll 24 relative to the fixed scroll 22. Scroll compressors are well-known in the art and U.S. Pat. Nos. 5,131,828 and 5,383,772, which provide disclosures of the structure and operation of scroll compressors and are assigned to the assignee of the present invention, are expressly incorporated herein by reference. In general, refrigerant at low pressure is drawn into suction pressure chamber 54 through suction tube 55 and introduced into the region between the intermeshed scroll wraps 26, 28, compressed therebetween by their relative orbiting motion, and expelled from between the scroll wraps through discharge port 51 in fixed scroll member 22 into first discharge pressure chamber 52, located in the uppermost region of housing 12. First discharge pressure chamber 52 is in fluid communication with second discharge pressure chamber 53, located in the lower portion of housing 12, through passages 42 extending between the inside wall of housing 12 and fixed scroll member 22 and frame 20, which are attached together by, for example, a plurality of bolts 23. High pressure fluid exits compressor 10 through discharge tube 56, which opens into second discharge pressure chamber 53.

The orbiting scroll member 24 includes depending pedestal portion 30 which is mounted to roller 32 via intermediate bearing 34. Roller 32 is journaled about or fixedly mounted to eccentric crankpin 35 of crankshaft 36. Anti-rotation means such as, for example, Oldham coupling ring 50 disposed between scroll members 22 and 24, are used to prevent the orbiting scroll 24 from freely rotating about its own axis as it is orbited about the axis of the crankshaft 36.

In the shown embodiment, oil is conveyed from oil sump 19, which is under discharge pressure, through passageway 44 in crankshaft 36 and is expelled through opening 46 in the topmost end of crankpin 35, lubricating bearing 34 and the interface between roller 32 and crankpin 35, which may also include a journal bearing (not shown). Oil that exits the bottom of bearing 34 returns to oil sump 19 via passageway 21 in frame 20. Alternatively, a radially directed passage (not shown) extending between passageway 44 and the outside surface of roller 32 can be used to supply lubricating oil directly to bearing 34, passageway 46 formed such that opening 46 in the topmost end of crankpin 35 would not here be provided. In either of these two embodiments, oil is also provided through orifice 48, located in orbiting scroll member 24, from the region where orbiting scroll member 24 and roller 32 interface to the region between scroll wraps 26, 28 which is, during normal compressor operation, at a pressure intermediate those experienced in discharge pressure chambers 52, 53 and suction pressure chamber 54. Introduction of oil into the region between scroll wraps 26, 28 provides lubrication of the sliding surfaces therebetween and between fixed and orbiting scroll member inner faces 38 and 40, respectively, from which wraps 26 and 28, respectively, project, and the wrap tips slidably engaged thereon. The lubrication of the sliding surfaces reduces the frictional resistance encountered in movement of orbiting scroll 24, thereby reducing frictional power losses during operation of scroll compressor 10, and prolongs the useful life of the sliding surfaces.

As orbiting scroll member 24 is moved, a fluid such as refrigerant gas is compressed between scroll wraps 26, 28 and creates a separating force which acts on fixed and orbiting scroll member inner faces, 38 and 40. The force generated by the compressed fluid tends to axially separate the two scrolls 22, 24. Through use of the present invention, orbiting scroll 24 can be biased towards fixed scroll 22 during compressor operation to overcome the axial separation force and bias the scrolls 22, 24 into mutual engagement.

Scroll compressor 10, as seen in FIG. 1, has frame 20 including main bearing portion 58 which radially supports crankshaft 36 through journal bearing 57. As best seen in FIG. 2, a recessed portion of frame 20 upwardly adjacent main bearing portion 58 receives orbiting scroll member pedestal portion 30 and is defined by substantially planar frame surface 60 and generally cylindrical wall 62. Substantially planar bottom surface 64 of orbiting scroll pedestal portion 30 lies parallel to frame surface 60 and has therein annular seal groove 66 and its associated seal 68. Seal 68 is of such a size and material that it maintains sliding engagement with frame surface 60 as orbiting scroll member 24 orbits relative to frame 20 and assumes its axial position biased toward fixed scroll member 22 in response to the axial compliance means discussed below. Thus, it can be seen, with reference to FIGS. 3 and 4, that seal 68 establishes a boundary between inner and outer pedestal bottom surfaces 70 and 72, respectively.

The outer surface of pedestal portion 30 may have large annular groove 74 therein. Orbiting scroll member 24 also includes, adjacent pedestal portion 30, substantially flat bottom face 76 which is substantially parallel to orbiting scroll face 40. Face 76 is disposed above and parallel to planar frame surface 78, which is adjacent and substantially perpendicular to generally cylindrical frame wall 62. Face 76 has therein annular seal groove 80 and its associated seal 82. Seal 82 is of such a size and material that it maintains sliding engagement with frame surface 78 as orbiting scroll member 24 orbits relative to frame 20 and assumes its axial position biased toward fixed scroll member 22 in response to the axial compliance means discussed below. Seal 82 thus establishes a boundary between inner and outer bottom face surfaces 84 and 86, respectively.

The above-described arrangement provides intermediate pressure chamber 88 bounded by seals 68 and 82, generally cylindrical frame wall 62, the outside surface of orbiting scroll member pedestal portion 30, orbiting scroll member inner bottom face surface 84 and the portion of planar frame surface 78 therebelow, and outer pedestal bottom surface 72 and the portion of planar frame surface 60 therebelow. Within chamber 88, as will be further addressed below, fluid is disposed at a pressure intermediate suction and discharge pressures during normal compressor operation. The region outside seal 82 is in fluid communication with suction pressure chamber 54 and thus outer bottom outer face surface 86 and the portion of frame 20 thereunder is subjected to suction pressure during compressor operation. The region inside seal 68, bounded in part by inner pedestal bottom surface 70 and the inside surface of pedestal portion 30 is in fluid communication with second discharge chamber 53 through passageways 21 and 44 and is generally flooded with oil. This latter region is thus subjected to discharge pressure during compressor operation. The respective pressures on surfaces 86 and 70 and the surface of orbiting scroll member 24 adjacently above roller 32 and crankpin 35 generate axially directed forces which combine with the axial intermediate pressure forces exerted on orbiting scroll member inner bottom face surface 84 and outer pedestal bottom surface 72 to exert the total axial compliance force which overcomes the axial scroll separating force generated during compression. The net axial compliance force, which ensures sealing, sliding engagement between wraps 26, 28 and scroll faces 40, 38, respectively, is the difference between the total axial compliance force and the axial scroll separating force.

Figure 3:
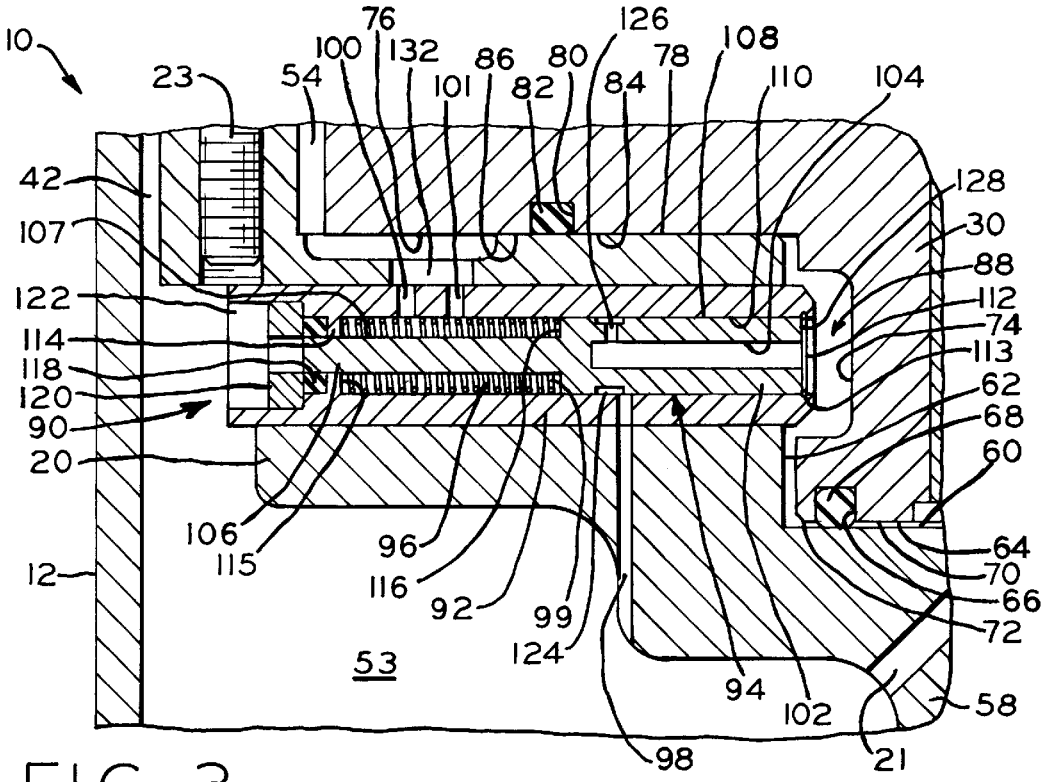
FIG. 3 is an enlarged, fragmentary sectional view showing the valve mechanism of the present invention in position to fluidly communicate the discharge pressure chamber and the intermediate pressure chamber.
Figure 4:
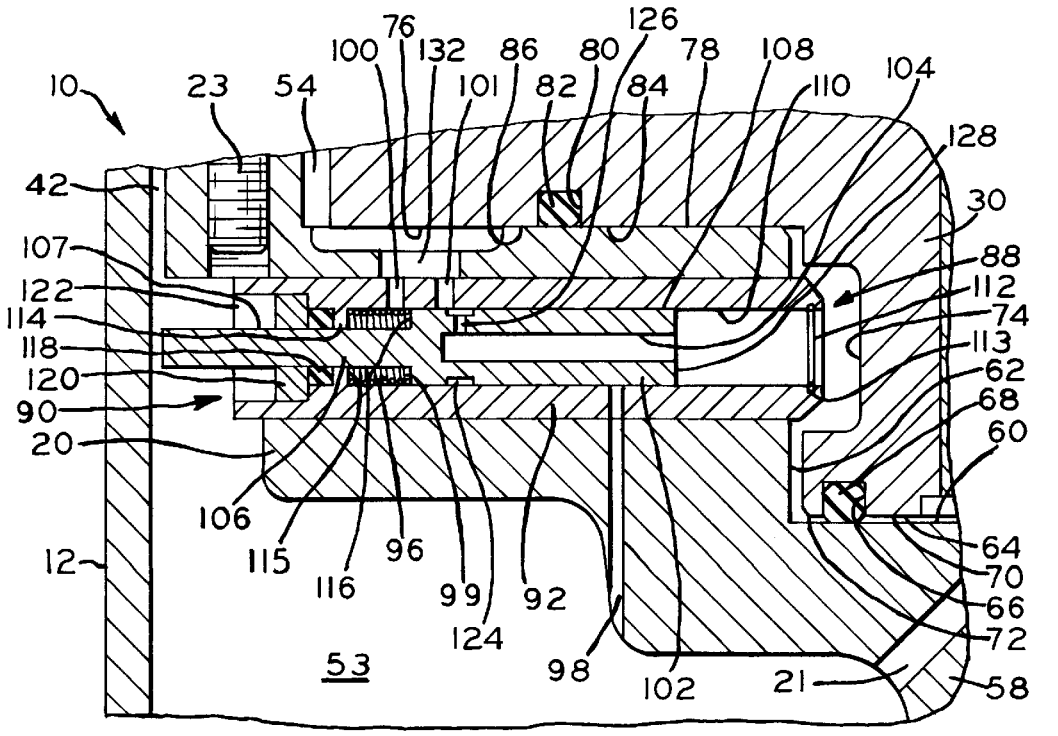
FIG. 4 is an enlarged, fragmentary sectional view showing the valve mechanism of the present invention in position to fluidly communicate the suction pressure chamber and the intermediate pressure chamber.

Intermediate pressure regulating valve assembly 90 generally comprises valve body 92, valve piston 94 and compression spring 96, which may be steel. Valve body 92 and valve piston 94 may be made from sintered powdered metal, machined cast iron, steel or aluminum, or injection molded of thermosetting plastic. As shown in FIGS. 3 and 4, valve body 92 has a hollow, somewhat cylindrical shape, although its outer surface may instead have a rectangular section (not shown), and is adapted to be fixed within a generally radially oriented receiving hole in frame 20, as by an interference fit, such that one end of valve body 92 opens into intermediate pressure chamber 88 and the opposite end of valve body 92 opens into second discharge pressure chamber 53. Discharge gas passageway 98 extends through frame 20 and one side of valve body 92 and, in the operation of valve assembly 90, serves to provide fluid at discharge pressure from second discharge pressure chamber 53 to intermediate pressure chamber 88. Suction gas passageway 101, located radially outward from discharge gas passageway 98 along valve body 92 extends through one side of valve body 92 and communicates with passageway 132 in frame 20. In the operation of valve assembly 90, passageways 101, 132 serve to vent fluid at intermediate pressure from intermediate pressure chamber 88 to suction pressure chamber 54. Fluid at intermediate pressure within chamber 88 acts on the area of orbiting scroll member inner face surface 84 and outer pedestal bottom surface 72, defined by the area within seal groove 80 and outside seal 68 to produce part of the axial compliance force which opposes axial separation of scroll members 22 and 24 during compressor operation. How fluid is transferred between chambers 53, 88 and 54 via valve assembly 90 is discussed below.

Figure 5:
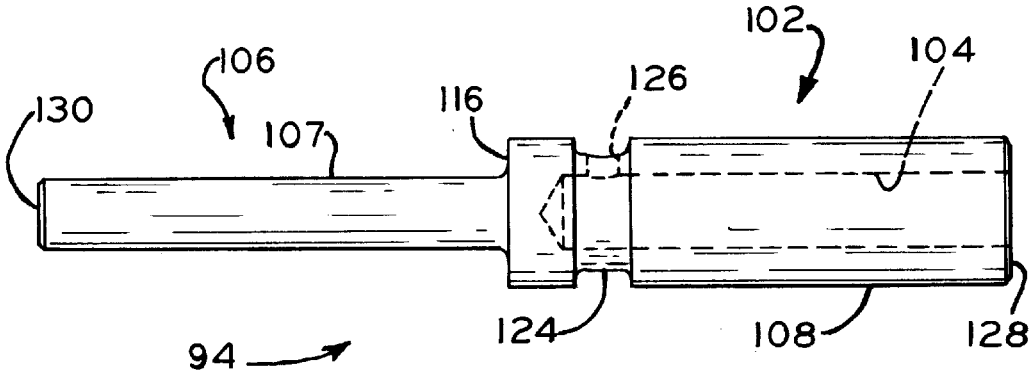
FIG. 5 is a side view of the valve of the present invention.
Figure 6:
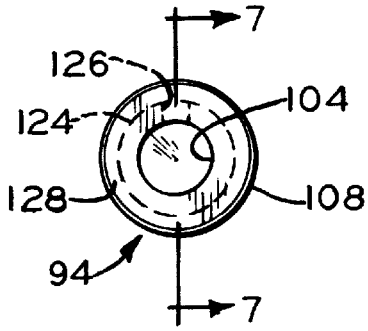
FIG. 6 is an end view of the valve shown in FIG. 5.
Figure 7:
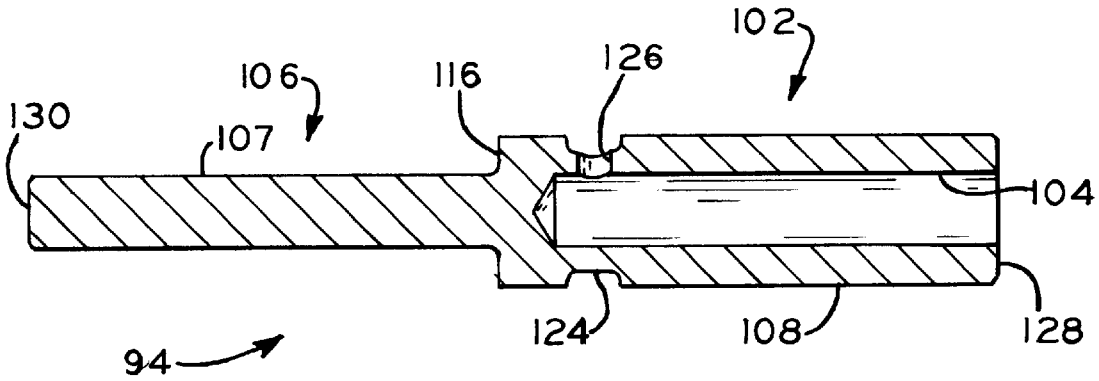
FIG. 7 is a longitudinal sectional view of the valve shown in FIGS. 5 and 6 along line 7—7 of FIG. 6.

Valve body 92 includes near its radially outward end inwardly projecting annular stop 114. In the embodiment shown in FIGS. 1–4, compression spring 96 is disposed within valve body 92 with one of its ends abutting annular surface 115 of stop 114. Referring now to FIGS. 5–7, generally cylindrical valve piston 94 is comprised of barrel portion 102 having longitudinal bore 104 and a free end area 128, and shaft portion 106 having a free end area 130. Barrel portion free end area 128 encompasses the entire end face area of barrel portion 102 exposed to intermediate pressure chamber 88, including the diametrical area of bore 104. The diameter of shaft portion 106 is appreciably smaller in diameter than the outside diameter of barrel portion 102 and at the juncture of coaxial portions 102 and 106 is annular shoulder 116. Near the juncture of shaft portion 106 and barrel portion 102, barrel portion outside surface 108 has annular groove 124. Port 126 extends radially through the cylindrical wall of piston 94, fluidly communicating annular groove 124 and longitudinal bore 104.

As seen in FIGS. 3 and 4, valve piston 94 is received within valve body 94 such that outside surface 108 of valve piston barrel portion 102 is in sliding engagement with inside surface 110 of valve body 92. Shaft portion 106 extends through spring 96 and the center of annular valve body stop 114, the end of spring 96 opposite stop 114 abutting shoulder 116. Valve assembly 90 is sealed against intrusion by discharge gases leaking by piston shaft portion 106 and valve body stop 114 by providing seal 118, which may be neoprene rubber, through which shaft portion 106 slidably engages, on the side of valve body stop 114 opposite spring-bearing surface 115. Annular end plug 120, which may be made from sintered powdered metal, machined from cast iron, steel or aluminum, or be injection molded plastic, is fitted tightly into cylindrical cavity 122 at the radially outward end of valve body 92, retaining seal 118. End plug 120 may be held in place within cavity 122 by interference fit or by staking a portion of the valve body material appropriately. Shaft portion 106 extends through the center aperture of end plug 120 and out of valve body 92 during compressor operation as piston 94 travels radially outward within valve body 92. Snap ring 112 may be provided in a mating receiving groove 113 inside valve body 92, near its radially inward end, to serve as a stop limiting the radially inward travel of valve piston 94. Suction pressure chamber 99, having annular cross section, is defined by inside surface 110 of valve body 92, outside surface 107 (FIG. 5) of valve piston shaft portion 106, annular shoulder 116 (FIG. 5) of valve piston 94 and surface 115 of valve body stop 114. Suction chamber 99 communicates with suction chamber 54 through passageway 132 in frame 20 and at least one of two passageways 100, 101 which extend radially through valve body 92. Passageway 100 lies radially outward of passageway 101 along valve body 92 and both passageways 100, 101 extend into passageway 132.

Before compressor 10 starts, pressure is equalized throughout the refrigeration system (not shown) comprised of compressor 10, refrigerant lines, heat exchangers and a receiver, if any. Because valve piston shaft free end area 130 and the area of annular valve piston shoulder 116 combine to equal valve piston barrel free end area 128 (FIGS. 5 and 7), the equalized pressure acting on these axial surfaces of valve piston 94 produces equally opposing axial forces to be exerted thereon. Thus, the forces due to pressure do not bias valve piston 94 toward either end of valve body 92. However, compression spring 96 urges valve piston 94 radially inward along valve body 92 such that annular groove 124 is maintained in communication with discharge gas passageway 98 in frame 20 and valve body 92. Hence, intermediate pressure chamber 88 is in communication with second discharge pressure chamber 53 via piston bore 104, port 126, annular groove 124 and passageway 98 as shown in FIG. 3.

Upon compressor startup, fluid pressure in discharge pressure chambers 52, 53 and connected intermediate pressure chamber 88 increases to a point that the net pressure induced force on valve piston 94 overcomes the force exerted by valve body stop 114 through spring 96 and valve piston 94 moves radially outward along valve body 92 to the point that annular groove 124 is no longer in communication with passageway 98. At this point, intermediate pressure chamber 88 is sealed and not in communication with either discharge pressure chambers 52, 53 or suction pressure chamber 54.

Should discharge fluid pressure appreciably drop during compressor operation, resulting in scroll members 22 and 24 become too tightly biased together, valve piston 94 will continue to move radially outward along valve body 92, against the force of spring 96, under the force induced by the pressure differential between intermediate pressure in chamber 88 and the suction pressure in chamber 99 in combination with the now lowered discharge pressure in discharge pressure chambers 52, 53 to the point where annular groove 124 communicates with passageways 101, 132 as shown in FIG. 4, thereby allowing fluid to vent from intermediate pressure chamber 88 into suction pressure chamber 54. The pressure in chamber 88 thus reduced, scrolls 22 and 24 no longer suffer overly tight engagement therebetween. Further, as the pressure in chamber 88 falls, a combination of spring force and net pressure induced forces on valve piston 94 moves same radially inward along valve body 92 such that chamber 88 is no longer in communication with suction pressure chamber 54.

Should discharge fluid pressure appreciably rise during compressor operation, urging drive scroll members 22, 24 apart and out of their proper axial engagement, a combination of the resultant increased force on shaft portion free end area 130, suction pressure in chamber 99 and the spring force will drive piston 94 radially inward along valve body 92 such that annular groove 124 communicates with passageway 98, increasing the pressure in chamber 88. Thus, orbiting scroll member 24 is forced into tighter axial engagement with fixed scroll member 24, counteracting the increased axial separation force.

Should suction fluid pressure appreciably rise during compressor operation, gas pressures between scroll wraps 26, 28 will correspondingly increase, urging drive scroll members 22, 24 apart and out of their proper axial engagement. The increase in suction pressure, however, will be communicated to chamber 99 through suction passageways 100, 101, 132 and urge valve piston 94 radially inward along valve body 92 such that annular groove 124 in brought into communication with passageway 98, establishing communication between intermediate pressure chamber 88 and discharge pressure chamber 53. Hence, the pressure in chamber 88 is increased and orbiting scroll member 24 is forced into tighter axial engagement with fixed scroll member 24, counteracting the increased axial separation force.

Should suction fluid pressure appreciably drop during compressor operation, gas pressures between scroll wraps 26, 28 will correspondingly decrease, resulting in scroll members 22 and 24 become too tightly biased together. The decrease in suction pressure, however, will be communicated to chamber 99 through suction passageways 100, 101, 132, reducing the pressure induced force against valve piston shoulder 116 and allowing valve piston 94 to move radially outward along valve body 92 to the point where annular groove 124 communicates with passageways 101, 132, as shown in FIG. 4, thereby allowing fluid to vent from intermediate pressure chamber 88 into suction pressure chamber 54. The pressure in chamber 88 thus reduced, scrolls 22 and 24 no longer suffer overly tight engagement therebetween. Further, as the pressure in chamber 88 falls, a combination of spring force and net pressure induced forces on valve piston 94 moves same radially inward along valve body 92 such that chamber 88 is no longer in communication with suction pressure chamber 54.

In the above described manner the intermediate pressure regulating valve and intermediate pressure chamber provide self-adjusting axial compliance means for a scroll compressor. In reducing the inventive intermediate pressure regulating valve to practice, it has been found that using a compression spring 96 having a spring constant of 0.9 pounds per inch with a preload of 1.0 pound, a barrel portion free end area 128 of 0.0491 square inches, a shaft portion free end area 130 of 0.0123 square inches and annular shoulder 116 having an area of 0.0368 square inches achieves a desirable result. These parameters are illustrative of but one embodiment of the present invention and are not to be considered as limiting the scope of the invention. Notably, compression spring 96 is not required to practice the present invention and serves only to increase the speed at which valve assembly 90 regulates pressure in intermediate pressure chamber 88.

While this invention has been described as having an exemplary design, the present invention may be further modified within the spirit and scope of this disclosure. This application is, therefore, intended to cover any variations, uses, or adaptations of the invention using its general principles. Further, this application is intended to cover such departures from the present disclosure as come within known or customary practice in the art to which this invention pertains. Accordingly, the scope of the invention should be determined not by the illustrated embodiments but by the following claims and their legal equivalents.

What is claimed is:

1. A scroll compressor having a suction pressure chamber and a discharge pressure chamber comprising:

a first scroll member having a first involute wrap element projecting from a first substantially planar surface;

a second scroll member having a second involute wrap element projecting from a second substantially planar surface and a third surface opposite said second substantially planar surface, said first and second scroll members adapted for mutual engagement with said first involute wrap element projecting towards said second surface and said second involute wrap element projecting towards said first surface, said first surface positioned substantially parallel with said second surface whereby relative orbiting of said scroll members compresses fluids between said involute wrap elements;

an intermediate pressure chamber in part bounded by said third surface of said second scroll member; and means for communicating said intermediate pressure chamber with one of the discharge pressure chamber and the suction pressure chamber in response to pressure differentials existing between said intermediate pressure chamber, the discharge pressure chamber and the suction pressure chamber;

whereby said first and second scroll members are maintained in axial sealing engagement by forces induced by fluid pressure in said intermediate pressure chamber.

2. A scroll compressor having a suction pressure chamber and a discharge pressure chamber comprising:

a first scroll member having a first involute wrap element projecting from a first substantially planar surface;

a second scroll member having a second involute wrap element projecting from a second substantially planar surface and a third surface opposite said second substantially planar surface, said first and second scroll members adapted for mutual engagement with said first involute wrap element projecting towards said second surface and said second involute wrap element projecting towards said first surface, said first surface positioned substantially parallel with said second surface whereby relative orbiting of said scroll members compresses fluids between said involute wrap elements;

an intermediate pressure chamber in part bounded by said third surface of said second scroll member; and a valve communicating said intermediate pressure chamber with the discharge pressure chamber in a first position and with the suction pressure chamber in a second position, said valve activated by fluid pressure differentials existing between said intermediate pressure chamber, the discharge pressure chamber and the suction pressure chamber;

whereby said first and second scroll members are maintained in axial sealing engagement by forces induced by fluid pressure in said intermediate pressure chamber.

3. The scroll compressor of claim 2, wherein said intermediate pressure chamber communicates with neither the discharge pressure chamber nor the suction pressure chamber when said valve is in a position intermediate said first and said second positions.

4. The scroll compressor of claim 2, wherein said valve has a first surface area exposed to said intermediate pressure chamber, a second surface area exposed to the discharge pressure chamber, and a third surface area exposed to the suction pressure chamber, pressures on said first, said second and said third surface areas generating forces which move said valve between said first and said second positions.

5. The scroll compressor of claim 2, further comprising a spring, said spring biasing said valve towards said first position.

6. The scroll compressor of claim 2, further comprising a hollow valve body in which said valve is slidably disposed, the interior of said valve body in communication with said intermediate pressure chamber, said valve body interior in communication with the discharge pressure chamber through a first conduit, said valve body interior in communication with the suction pressure chamber through a second conduit, said intermediate pressure chamber in connection with the discharge pressure chamber and the suction pressure chamber via said first and said second conduits, respectively.

7. The scroll compressor of claim 6, wherein said valve includes a bore in communication with said intermediate pressure chamber and a passageway through which said bore is placed in communication with said first and said second conduits when said valve is in said first and said second positions, respectively.

8. The scroll compressor of claim 6, further comprising a spring operably positioned between said valve and said valve body, said spring biasing said valve towards said first position.

9. The scroll compressor of claim 6, wherein said valve is generally cylindrical, and said valve body interior is partly defined by a cylindrical surface.

10. The scroll compressor of claim 6, wherein said valve is adapted to move linearly in directions toward and away from said intermediate pressure chamber.

* * * * *